US006254097B1

(12) United States Patent
Larner

(10) Patent No.: US 6,254,097 B1
(45) Date of Patent: Jul. 3, 2001

(54) TRAVELING BINGO PLAYER

(76) Inventor: Suzanne Larner, 199-05 17th Ave., Whitestone, NY (US) 11357

( * ) Notice: Subject to any disclaimer, the term of this patent is extended or adjusted under 35 U.S.C. 154(b) by 0 days.

(21) Appl. No.: 09/324,127

(22) Filed: Jun. 2, 1999

(51) Int. Cl.[7] ..... A63F 3/06

(52) U.S. Cl. ..... 273/269; 273/274; 273/287; 273/285

(58) Field of Search ..... 273/236, 269, 273/270, 287, 285, 286, 274

(56) References Cited

U.S. PATENT DOCUMENTS 2,282,871 * 5/1942 Malbon .
4,133,536 * 1/1979 Cole .
4,226,420 * 10/1980 Corday .
4,703,933 * 11/1987 Cahill .
4,767,119 * 8/1988 Fadner .

* cited by examiner

*Primary Examiner*—Benjamin H. Layno
*Assistant Examiner*—V K Mendiratta
(74) *Attorney, Agent, or Firm*—Michael I. Kroll

(57) ABSTRACT

The present invention 10 discloses a foldable game board 11 for playing bingo or the like having a plurality of playing surfaces 20 upon which surfaces is attached a part of hook and loop material 22 for having attached thereto either playing cards 12 having mating hook and loop material 28 attached to the back thereof or chips 14 having flocking material 18 attached to the back thereof so that when the playing card 12 or chip 14 is attached to the playing surface 20 it will not move until the player so chooses even when the playing surface is jostled about. Furthermore, the face of the playing card 12 has narrow lengths of a part of hook and loop material 16 which is placed between the rows and columns of numbers so that each number is encompassed by the hook and loop material 16 so that the chip 14 with the flocking material 18 attached to the back thereof can be attached securely thereto. The game board 11 is equipped with live hinges 15 so that it can be easily folded upon itself.

6 Claims, 7 Drawing Sheets

TRAVELING BINGO PLAYER

BACKGROUND OF THE INVENTION

1. Field of the Invention

The present invention relates generally to games and, more specifically, to a portfolio having one or more bingo game cards and a plurality of tokens attached thereon. Said portfolio, when folded, has a front side and a back side whereupon a logo or advertisement can be imprinted. Upon opening said portfolio, one or more bingo game cards and a plurality of tokens are accessible for playing especially, while traveling in a moving conveyance.

The portfolio is made from a rigid material, such as compressed paper, cardboard, or plastic and is comprised of a number of foldable sections having one part of hook and loop material attached thereon with the exception of the front and back.

The game or game cards and the plurality of tokens having a front side and a back side having a flocking material attached to the back side therein providing means for securing said game card or cards to the portfolio.

On each of the game cards is a length of hook and loop material adhesively attached between the columns and rows on the playing side of the game card or cards and wherein said hook and loop material being of the same mating type as that located on the portfolio surfaces thereby providing means for the transference of the tokens from a holding position on a portfolio surface to a game card surface.

2. Description of the Prior Art

There are other game apparatus designed to hold playing pieces by means of hook and loop, adhesive and magnetism. Typical of these is U.S. Pat. No. 2,282,871 issued to Malbon on May 12, 1942.

Another patent was issued to Hlavac on Jan. 12, 1954 as U.S. Pat. No. 2,665,913. Yet another U.S. Pat. No. 3,477,715 was issued to Nekton on Nov. 11, 1969 and still yet another was issued on Nov. 18, 1969 to Wagner as U.S. Pat. No. 3,479,034. Yet another U.S. Pat. No. 5,040,800 was issued to Ulan on Aug. 20, 1991 and still yet another was issued on Sep. 17, 1974 to Bowerman as U.S. Pat. No. 3,836,151.

U.S. Pat. No. 2,282,871

Inventor: Clifford B. Malbon

Issued: May 12, 1942

This United States Patent discloses improvements to game apparatus of the type in which game pieces or checkers are moved about on a game board. The game board surface is covered with a coating of flocking of cotton or other fibrous material, which is adhesively secured thereto so that a multiplicity of minute short fibers stand erect on the surface, and by coating the engaging surface or surfaces of the checkers in like manner, so that, when the checkers are merely placed on the board, the erect fibers on the board and checkers interlock and prevent the checkers from freely sliding on the board , or from being moved thereon by the action of gravity when the board is tilted even to a nearly vertical position, or from being moved from their positions when the board is accidentally moved suddenly or jarred, the construction permitting the checkers to be slid over the surface of the board nearly as easily as if the flocked surface were not present, and in no way interfering with the checkers from being lifted and placed in other positions.

U.S. Pat. No. 2,665,913

Inventor: Ludvik Hlavac

Issued: Jan. 12, 1954

This United States Patent discloses improvements to game apparatus of the type in which game pieces such as chess, checkers, backgammon, and parcheesi are moved about on a game board. The game board and game pieces are magnetically attracted whereby the game pieces maintain the positions to which they are moved on the surface of the board.

U.S. Pat. No. 3,477,715

Inventor: Armas H. Nekton

Issued: Nov. 11, 1969

This United States Patent discloses a chess board wherein the squares have vertical openings therethrough which receive the shafts of the playing pieces and an inked pad is placed below the openings and is engageable by the bottom ends of the shafts which bear identifying indicia. The playing pieces have reduced shanks received in openings having a corresponding diameter, the lead positions of the playing pieces being disposed above the board. Releasable means are provided for latching the playing pieces in suspended position above the pad. In use the game pieces are pushed into contact with the pad and are then withdrawn from the vertical opening and are stamped on a specially designed printed record sheet to indicate each play as it is made. Means are provided for supporting a record sheet above the inked pad.

U.S. Pat. No. 3,479,034

Inventor: Heinz Wagner

Issued: Nov. 18, 1969

This United States Patent discloses an amusement game or educational device incorporating a board or base plate upon which markers in the form of game pieces, figures, indicators or the like are placed. Both the base plate and the markers are formed at least partially of magnetic material, the base plate or the markers consisting at least partially of ferromagnetic material and the other element(s) at least partially of permanent magnetic material. Disposed over the base plate and at a distance therefrom is a cover plate of transparent material. The markers can be displaced by means of an external guide magnet acting through the cover plate so that such markers can be selectively positioned with respect to the base plate. The cover plate is mounted for movement to vary the spacing between the cover plate and the base plate, the outer limit of the range of adjustment being such as to render the guide magnet incapable of moving the markers.

U.S. Pat. No. 5,040,800

Inventor: Joel Ulan

Issued: Aug. 20, 1991

This United States Patent discloses an apparatus for a board game, wherein playing pieces are moved to and from designated positions on the game board's surface, has a vertically disposed planar game board with the playing surface area represented in perspective, giving the effect of depth and a three-dimensional appearance. Playing pieces, releasably held in their assigned positions by magnets or projections, are angularly truncated at their bases so that each piece when in place extends outwardly and upwardly from the playing surface at a predetermined angle.

U.S. Pat. No. 3,836,151

Inventor: William R. Bowerman

Issued: Sep. 17, 1974

This United States Patent discloses a self storing game apparatus in which a pliable game board or panel having a suitable game design emplaced thereon, such as by embossing, and a plurality of game playing pieces adapted to be selectively arranged on the panel in accordance with the design are made of a common material, as for example vinyl or the like, having a characteristic, which causes the pieces to adhere to the panel when in direct contact therewith. The pliable nature of the vinyl permits folding of the panel for storage purposes as, for example in the user's pocket purse, desk, etc., without the likelihood of the playing pieces being readily dislodged from their position when the panel in folded.

While these game apparatus may be suitable for the purposes for which they were designed, they would not be as suitable for the purposes of the present invention, as hereinafter described.

SUMMARY OF THE PRESENT INVENTION

The present invention discloses a foldable game board for playing bingo or the like having a plurality of playing surfaces upon which surfaces is attached a part of hook and loop material for having attached thereto either playing cards having mating hook and loop material attached to the back thereof or chips having flocking material attached to the back thereof so that when the playing card or chip is attached to the playing surface it will not move until the player so chooses even when the playing surface is jostled about. Furthermore, the face of the playing card has narrow lengths of a part of hook and loop material which is placed between the rows and columns of numbers so that each number is encompassed by the hook and loop material so that the chip with the flocking material attached to the back thereof can be attached securely thereto. The game board is equipped with live hinges so that it can be easily folded upon itself.

A primary object of the present invention is to provide a bingo game card whereby the bingo tokens will not move once placed on the bingo card even if the card is dropped.

Another object of the present invention is to provide a bingo card having a length of hook and loop material adhesively attached between the columns and rows on the playing side of the game card.

Yet another object of the present invention is to provide a bingo token having one side having a flocking material adhesively attached thereon providing means for removably attaching said bingo tokens to said bingo card.

Still yet another object of the present invention is to provide a portfolio having foldable section having one part of hook and loop material adhesively attached to all sections with the exception of the front and rear section.

Another object of the present invention is to provide a portfolio having means for selectively attaching one or more bingo game cards and a plurality of bingo tokens.

Yet another object of the present invention is to provide a portfolio which can be distributed by a vendor upon entering a motorized conveyance and wherein the players can purchase one or more bingo cards and place said bingo cards into said portfolio while playing the bingo game.

Additional another object of the present invention is to provide a portfolio having a front and rear side wherein a logo or advertisement can be imprinted thereon.

The present invention overcomes the shortcomings of the prior art by providing a bingo card having means for selectively attaching bingo tokens wherein said tokens will remain until selectively removed. In addition the present invention provides means for assembling and attaching one or more bingo cards onto a foldable playing surface whereupon a plurality of bingo tokens are removably attached to said playing surface where they will remain until selectively transferred to the playing surface of the bingo card.

The foregoing and other objects and advantages will appear from the description to follow. In the description reference is made to the accompanying drawings, which form a part hereof, and in which is shown by way of illustration specific embodiments in which the invention may be practiced. These embodiments will be described in sufficient detail to enable those skilled in the art to practice the invention, and it is to be understood that other embodiments may be utilized and that structural changes may be made without departing from the scope of the invention. In the accompanying drawings, like reference characters designate the same or similar parts throughout the several views.

The following detailed description is, therefore, not to be taken in a limiting sense, and the scope of the present invention is best defined by the appended claims.

BRIEF DESCRIPTION OF THE DRAWINGS

In order that the invention may be more fully understood, it will now be described, by way of example, with reference to the accompanying drawings in which.

LIST OF REFERENCE NUMERALS

Figure 1:
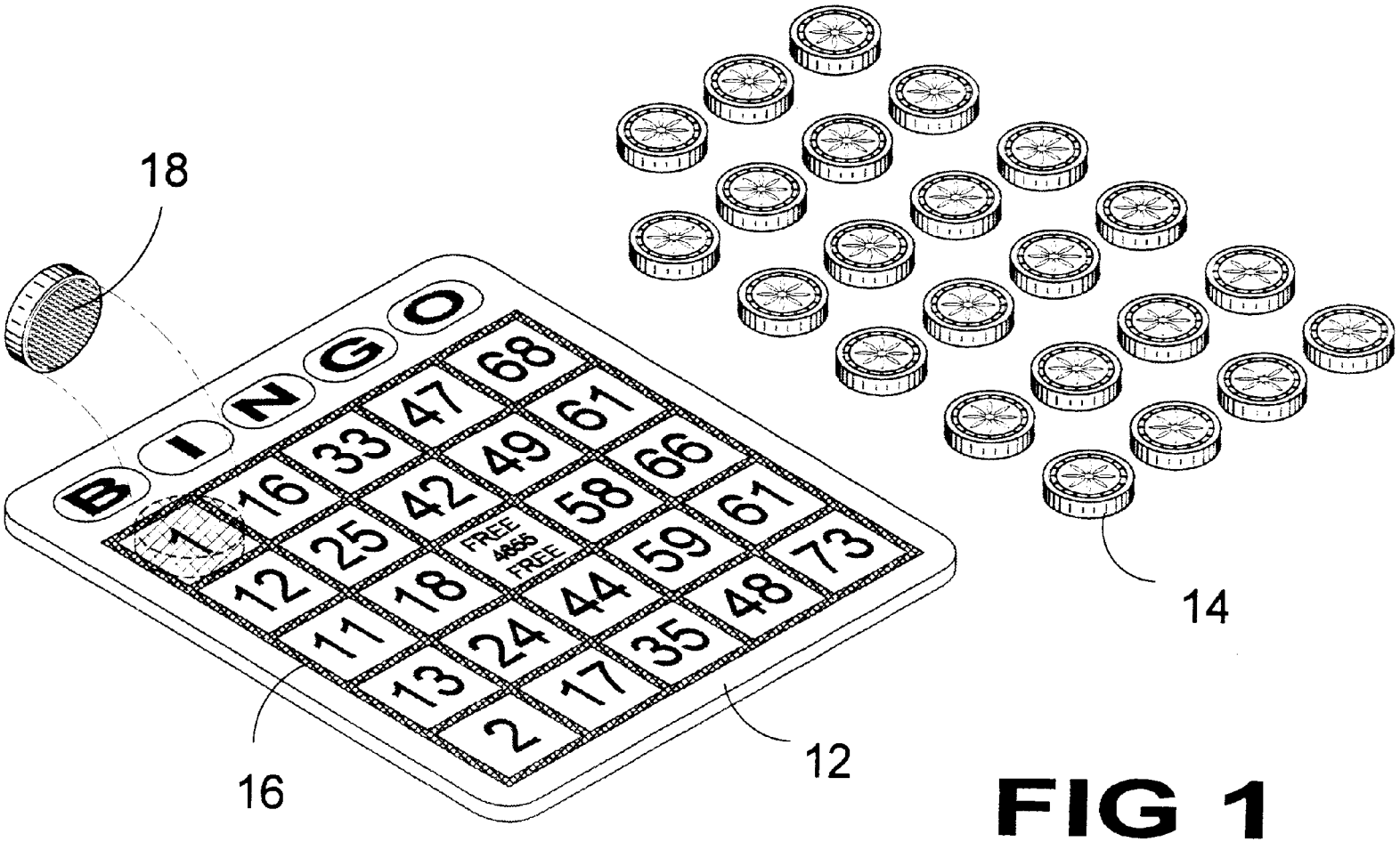
FIG. 1 is a perspective view of the bingo game card and a plurality of bingo tokens of the present invention. Shown is a game card having a length of hook and loop material adhesively attached between the rows and columns with a bingo token having a flocking material adhesively attached to one side whereby said bingo token will engage the game card hook and loop material whereby said bingo token will remain selectively positioned.

With regard to the reference numerals used, the following numbering is used drawings.

10 present invention
11 foldable game board
12 bingo card face
14 bingo chips
16 hook and loop material
18 flocking material
20 portfolio section
22 hook and loop material
24 front cover section
26 rear cover section
28 hook and loop material
30 back of bingo card
32 logo

DESCRIPTION OF THE PREFERRED EMBODIMENT(S)

Turning now descriptively to the drawings, in which similar reference characters denote similar elements throughout the several views, FIGS. 1 through 7 illustrate the present invention being a game board having hook and loop material attached thereto for holding bingo cards and playing chips.

Turning to FIG. 1, therein is shown a perspective view of the front surface of the bingo card 12 along with a plurality of bingo chips or tokens 14 which are part of the present invention 10 (not shown). Shown is a game card 12 having a narrow length of hook and loop material 16 adhesively attached between the rows and columns of numbers so that each number is encompassed by a square of the hook and loop material 16. Also shown therein is the flocking material 18 adhesively or otherwise attached to one side being the bottom side thereof whereby the bingo chip 14 will engage the hook and loop material 16 on the game card face 12 so that the bingo chip 14 will remain properly selectively positioned on the bingo card 12 even if the card 12 is jostled about.

Figure 2:
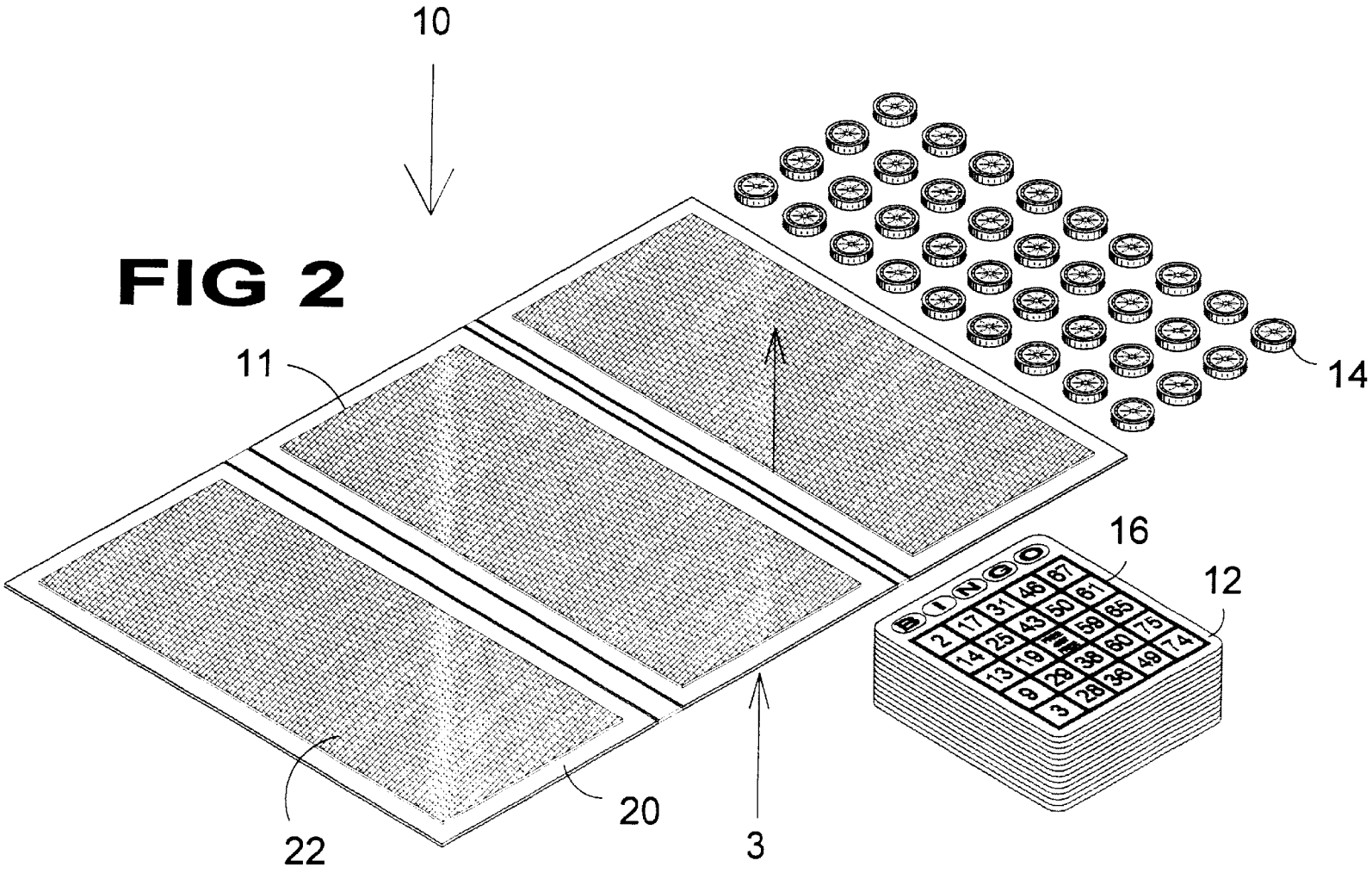
FIG. 2 is a perspective view of the components of the preferred embodiment of the present invention. Shown are a plurality of bingo cards having hook and loop material adhesively attached between the columns and rows and a plurality of bingo tokens. Also shown is a portfolio having a number of foldable sections having one part of a hook and loop material adhesively attached to each surface, with the exception of the front and rear cover sections, whereupon the back side of the bingo cards, not shown, has the mating part of the hook and loop material providing means for selectively positioning said bingo cards onto said portfolio. Also, the bingo tokens having a flocking material will be selectively positioned onto said portfolio.

Turning to FIG. 2, therein is shown a perspective view of the components of the preferred embodiment of the present invention 10. Shown are a plurality of bingo cards 12 having hook and loop material 16 adhesively attached between the columns and rows of numbers along with a plurality of bingo tokens or chips 14. Also shown is a foldable game board 11 having a number of foldable sections or surfaces 20 having a mating part 22 of a hook and loop material adhesively attached to each surface with the exception of the front and rear cover sections (not shown). The game board 11 folds in such a way as to form a portfolio or like device. The portfolio is made from a rigid material, such as compressed paper, cardboard, or plastic or the like. Also shown therein are the bingo cards 12 which have a mating part of hook and loop material on their back side (not shown) which provide means for selectively positioning the bingo cards 12 onto mating hook and loop material 22 on the portfolio sections 20 in such a manner that the user can participate in a bingo game thereon. Note that the bingo tokens 14 each have flocking material 18 (not shown) on their bottom side to allow them to also be selectively positioned onto said portfolio section hook and loop material 22.

Figure 3:
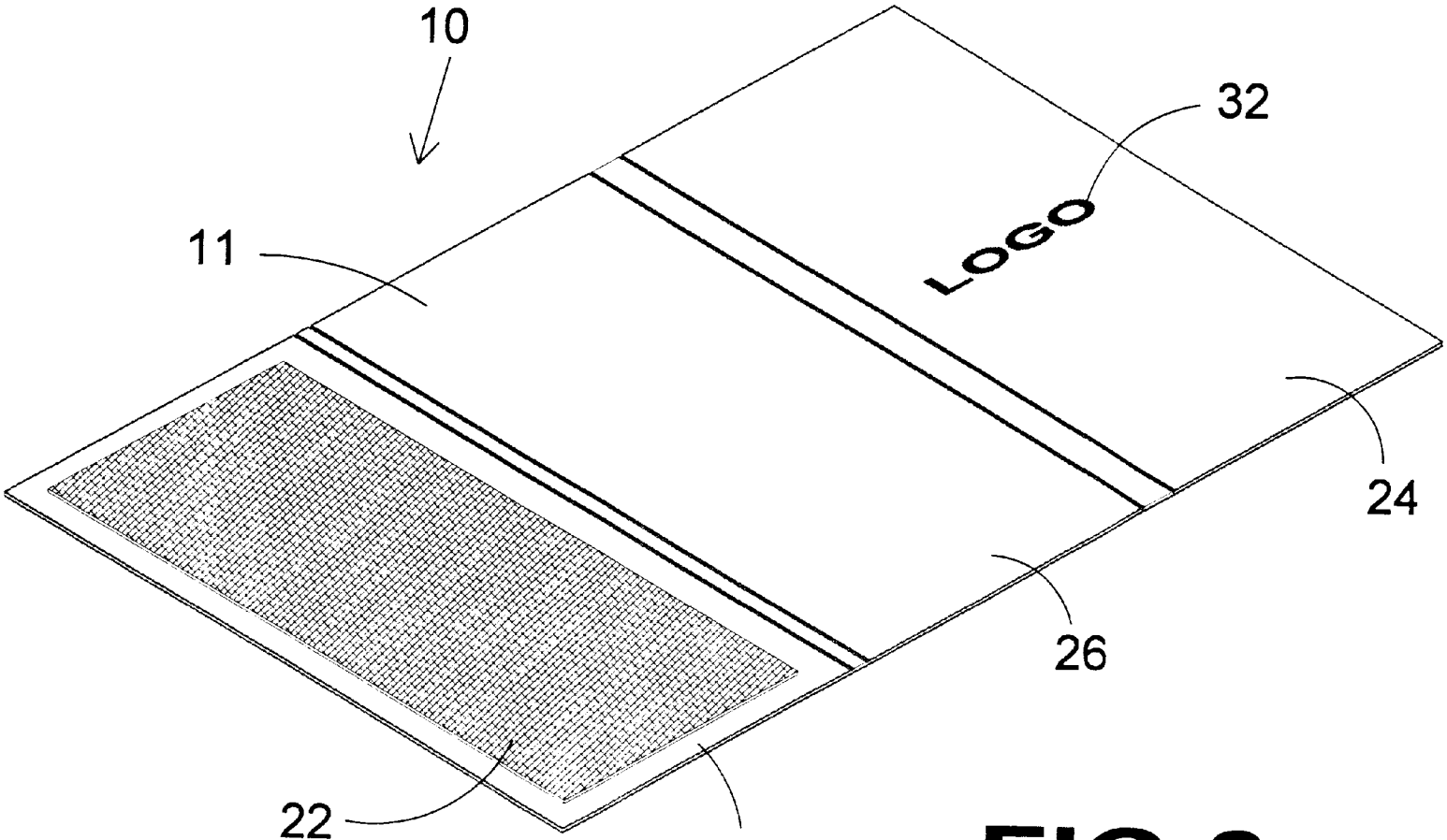
FIG. 3 is a perspective view of the other side of the portfolio, taken from the direction as indicated in FIG. 2, showing a number of portfolio sections having one part of a hook and loop material adhesively attached thereon, with the exception of the front and rear cover sections, whereupon the bingo cards having the mating part of the hook and loop material provides means for selectively positioning said bingo cards onto said portfolio. Also, the bingo tokens having a flocking material may be selectively positioned onto said portfolio hook and loop material sections. The front and rear cover not having hook and loop material attached thereon can be used for the purposes of displaying a logo or advertisement which may be embossed or imprinted thereon.

Turning to FIG. 3, therein is shown a perspective view of the opposite side of the foldable game board 11 of the present invention 10 taken from the direction as indicated in FIG. 2, showing a number of portfolio sections 20 having one mating part of hook and loop material 22 attached thereon. Front 24 and rear 26 cover sections do not have hook and loop material 22 attached thereto being effectively smooth whereby they can be used for the purposes of displaying a logo or advertisement 32 which logo may be embossed are imprinted thereon.

Figure 4:
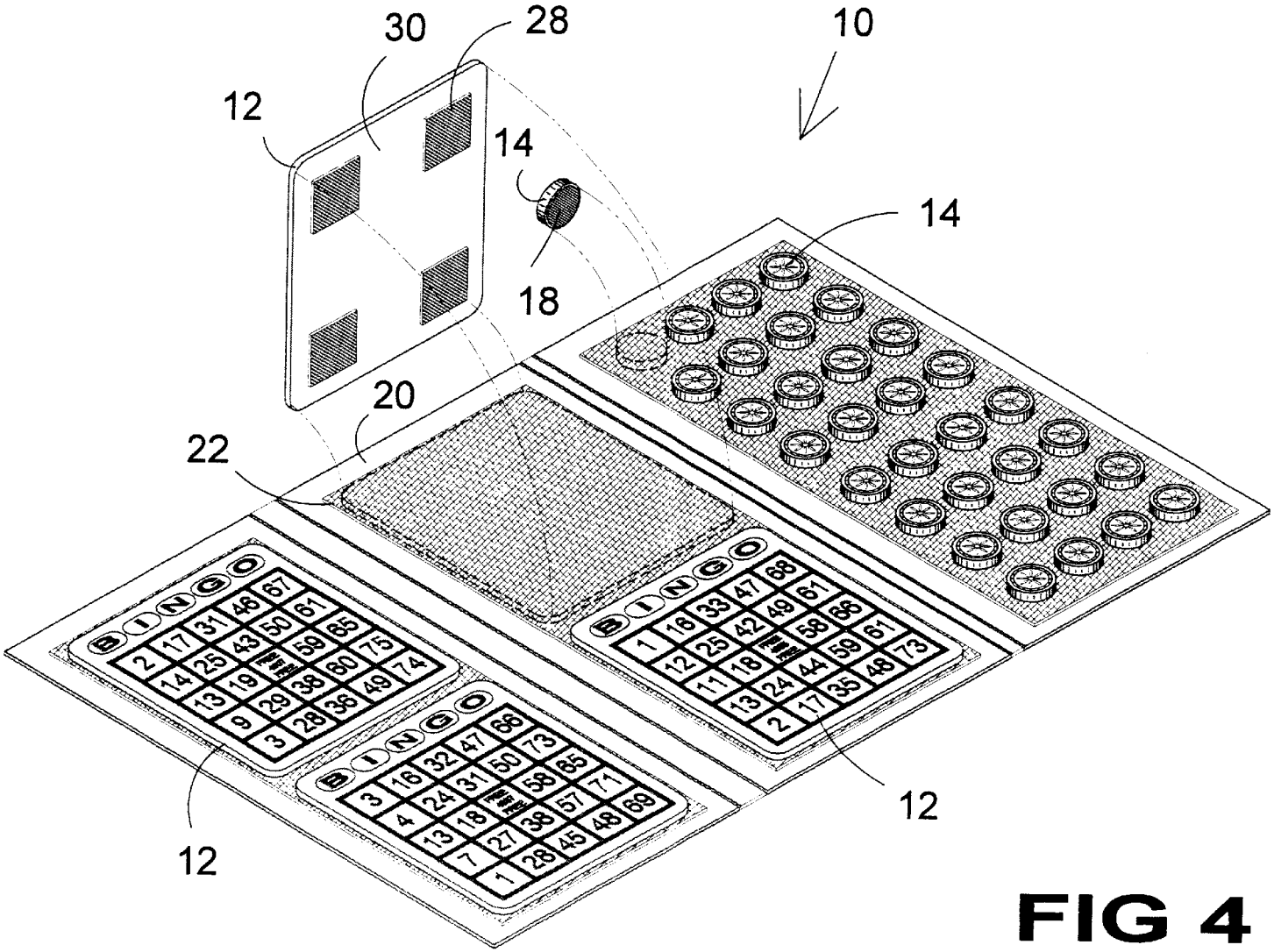
FIG. 4 is a perspective view of the components of the preferred embodiment of the present invention arranged in one possible configuration. Shown are a plurality of bingo cards having hook and loop material adhesively attached thereon providing means for selectively positioning said bingo cards onto said portfolio and the bingo tokens having a flocking material can also be selectively positioned onto said portfolio. Also said bingo cards having hook and loop material between the columns and rows of the playing surface provides means for selectively transferring said bingo tokens to said bingo playing surface wherein said bingo token will remain positioned until such time as determined by the player. Also shown is a game card removed from the portfolio hook and loop material surface showing a number of mating hook and loop material pieces attached thereon providing means for selectively positioning said bingo card to said portfolio. Also shown is a bingo token removed from the portfolio hook and loop material surface showing a bottom side having flocking material attached thereon providing means for selectively positioning said bingo token to said portfolio, as well as, selectively transferring said bingo token to said bingo playing card surface.

Turning to FIG. 4, therein is shown a perspective view of the components of the preferred embodiment of the present invention 10 arranged in one possible configuration. Shown are a plurality of bingo cards 12 having a mating part of hook and loop material 28 attached onto the back side 30 of the bingo card 12 which provides means for selectively positioning the bingo card 12 onto the hook and loop material 22 of the portfolio section 20. The bingo tokens 14 which have flocking material 18 on their bottom surface can also be selectively positioned onto the hook and loop material 22 of the portfolio sections 20. The bingo cards 12 have hook and loop material 16 on their front surfaces between the columns and rows of the numbered playing surface providing means for selectively transferring the bingo chips 14 to the bingo playing card surfaces 12 thereby providing means whereby the bingo token 14 will remain positioned on the bingo card 12 until removed by the player or user. Shown is a game card 12 removed from the portfolio surface showing a number of mating hook and loop material pieces 28 attached to the bottom thereof providing means for selectively positioning the bingo card 12 onto the hook and loop material 22 of the portfolio section 20. Also shown is a bingo token 14 removed from the portfolio section hook and loop material surface 22 showing a bottom side having flocking material 18 attached thereon providing means for selectively positioning the bingo chip 14 to the portfolio section 22 as well as selectively transferring the bingo chip 14 to the bingo card playing surface 12.

Figure 5:
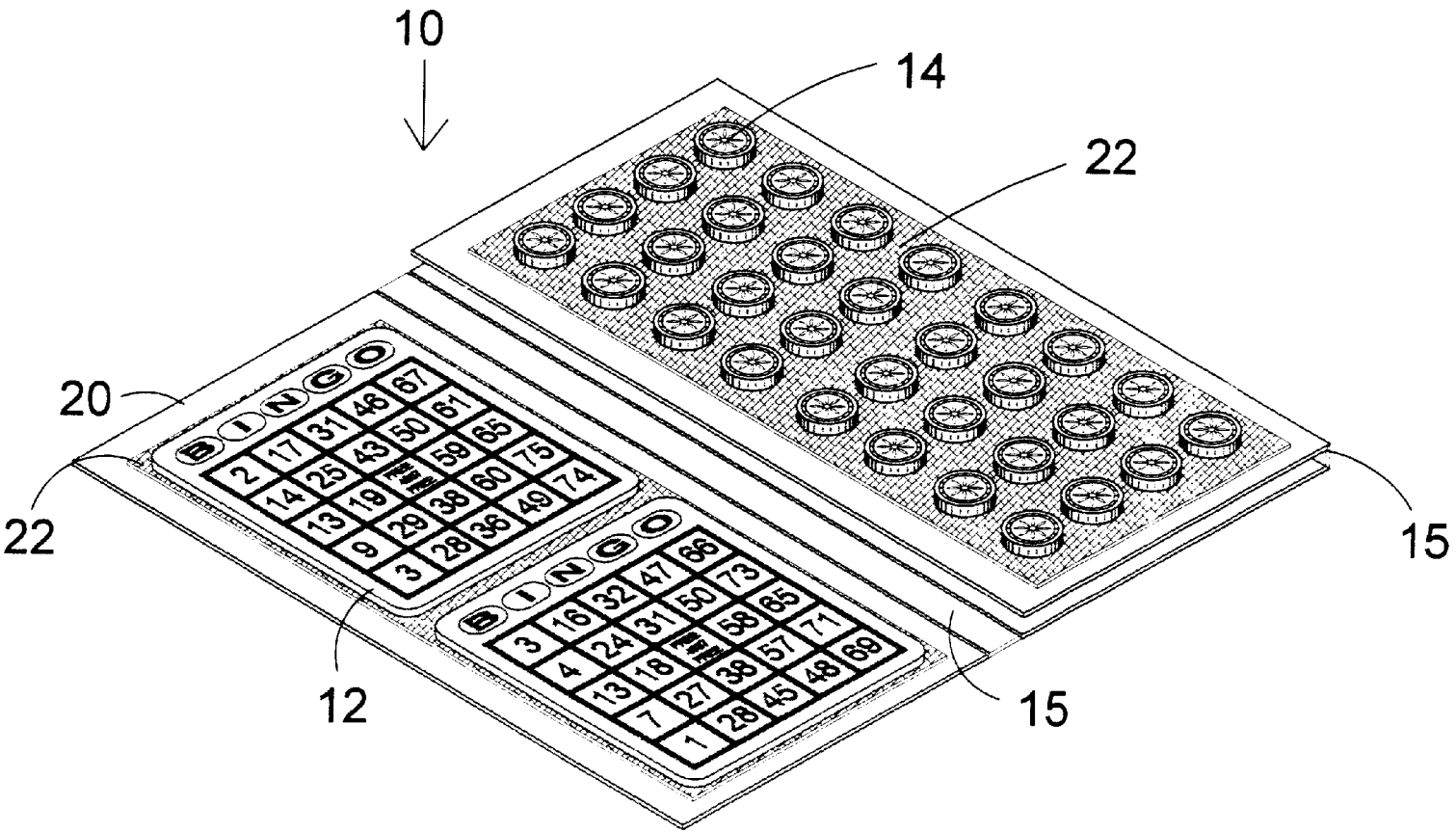
FIG. 5 is a perspective view of the portfolio of the preferred embodiment of the present invention in a partially folded position. Shown are a plurality of bingo cards attached thereon and a plurality of bingo tokens selectively positioned onto one portfolio section.

Turning to FIG. 5, therein is shown a perspective view of another preferred embodiment of the present invention 10 in a partially folded position. Shown are a plurality of bingo cards 12 attached to the hook and loop material 22 of the portfolio sections surface 20 along with a plurality of bingo tokens 14 selectively positioned onto an adjacent portfolio sections surface 22. Note that a live hinge 15 is provided between the sections 20 so that they may be easily folded upon each other.

Figure 6:
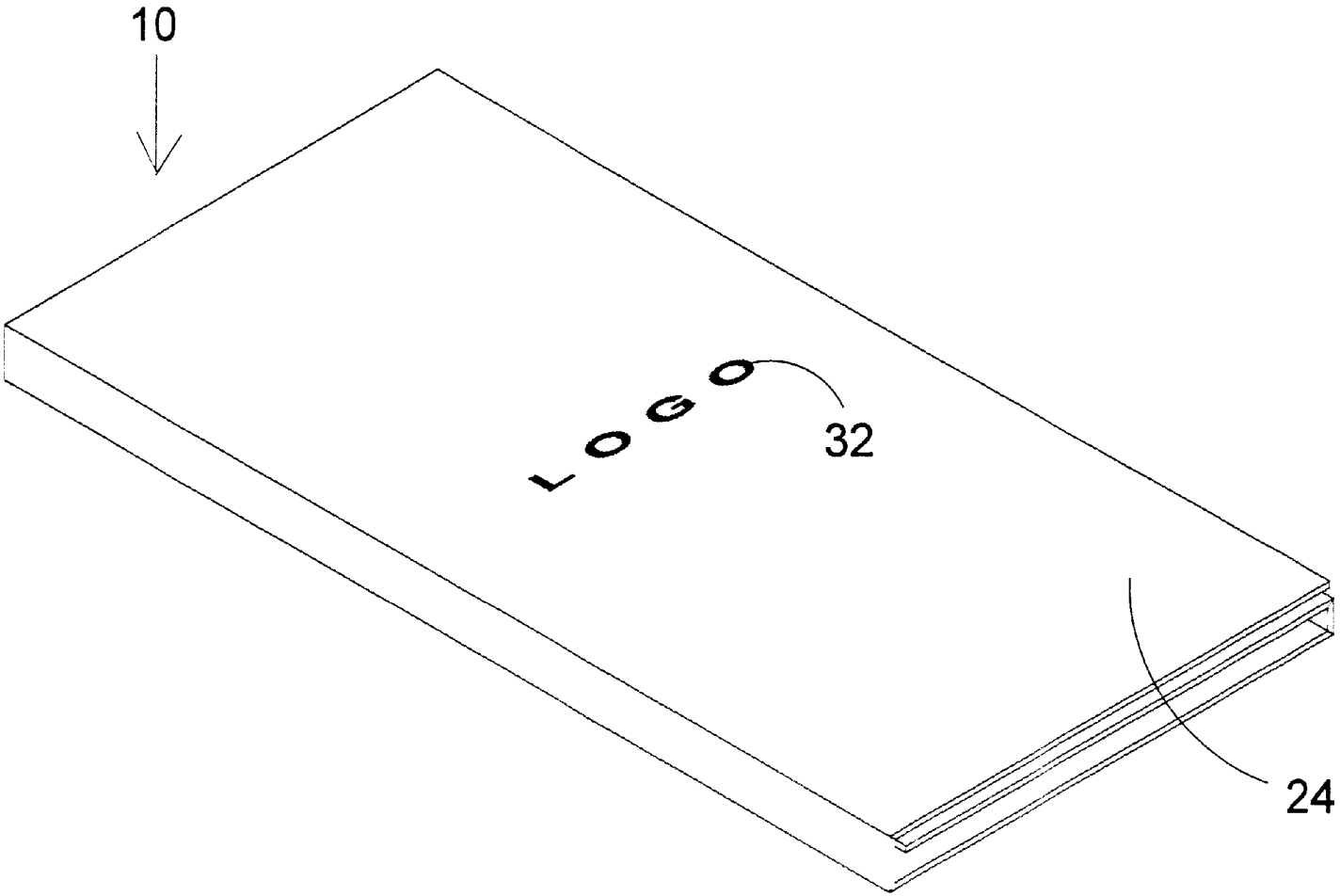
FIG. 6 is a perspective view of the portfolio of the preferred embodiment of the present invention in a folded closed position having a front section whereupon a logo or advertisement can be embossed or imprinted.

Turning to FIG. 6, therein is shown a perspective view of the preferred embodiment of the present invention 10 in a folded and closed position having a front section 24 whereupon a logo or advertisement 32 can be embossed or imprinted.

Figure 7:
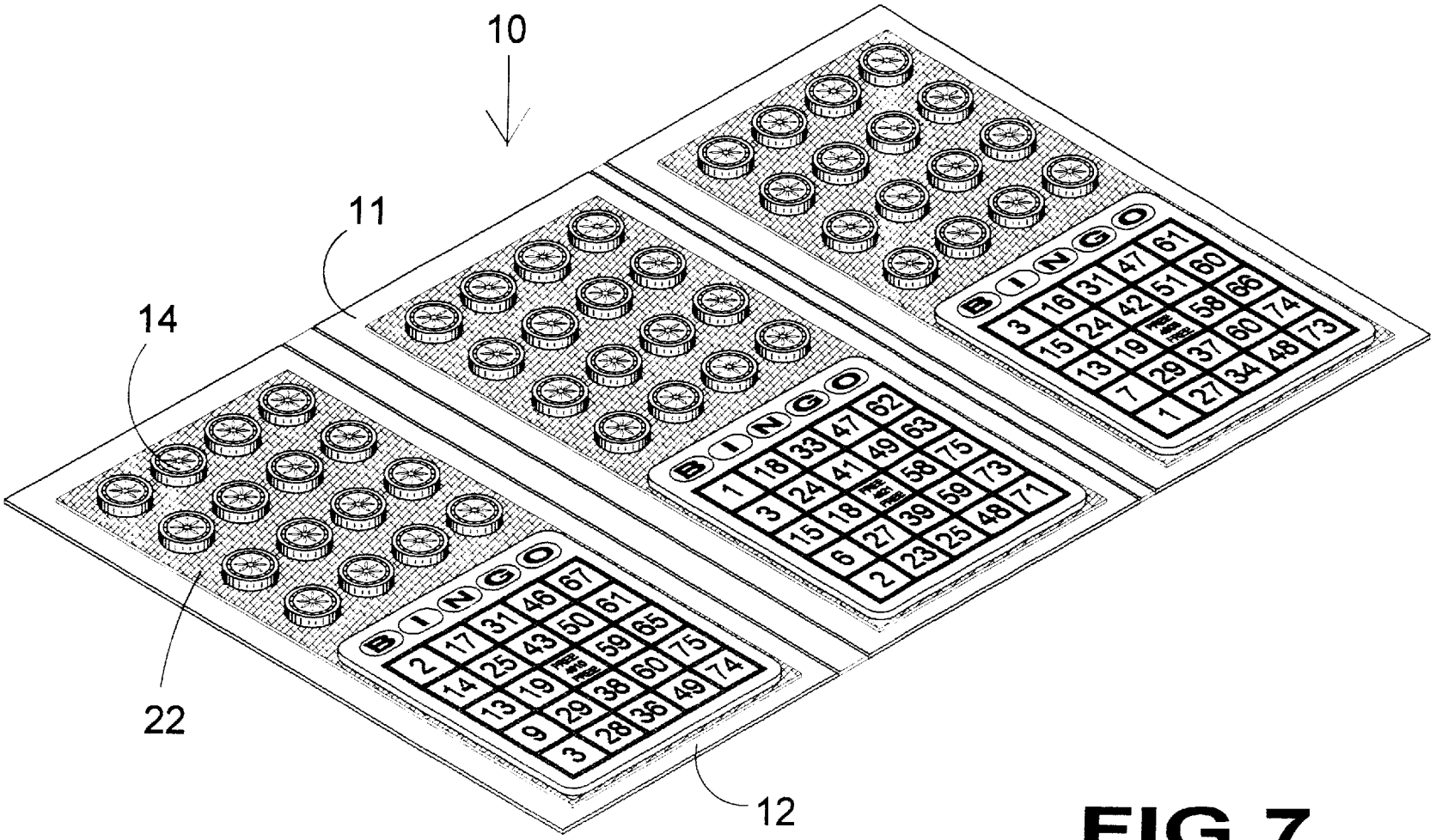
FIG. 7 is a perspective view of the portfolio of the preferred embodiment of the present invention in the open position showing another possible arrangement of the bingo cards and bingo tokens.

Turning to FIG. 7, therein is shown a perspective view of the portfolio or game board 11 of the present invention 10 in the open position showing an alternative arrangement of the bingo cards 12 and bingo chips 14 selectively positioned on the portfolio sections 22.

What is claimed to be new and desired to be protected by Letters Patent is set forth in the claims:

1. An apparatus for a game, comprising:

a) a game board;

b) a plurality of playing surfaces on said game board;

c) a part of hook and loop material attached to said playing surfaces;

d) a plurality of bingo playing cards;

e) a mating part of hook and loop material attached to bottoms of said playing cards whereby said playing cards are attached to said playing surfaces;

f) a plurality of narrow lengths of parts of hook and loop material attached to front surfaces of said playing cards outlining rows and columns of numbers whereby each number is encompassed by a square of the hook and loop material;

g) a plurality of playing chips;

h) a flocking material attached to one side of said playing chips whereby said playing chips can be attached to said playing surface or to said front surface of said playing cards; and, i) said game board having a front surface and a rear surface whereby a logo can be imprinted thereon.

2. The apparatus of claim 1, wherein said game board is foldable.

3. The apparatus of claim 2, said game board further comprising live hinges connecting said playing surfaces whereby said game board is foldable.

4. The apparatus of claim 1, said game board further comprises cardboard.

5. The apparatus of claim 1, said game board further comprises plastic.

6. The method of playing the game of bingo comprising the steps of:

a) opening up a game board, said game board having playing surfaces, said playing surfaces having a part of hook and loop material attached thereto;

b) placing on said playing surfaces a plurality of bingo playing cards, said playing cards having on a bottom surface a mating part of hook and loop material so that said playing cards are removably attached to said playing surfaces, said playing cards having on a front surface a plurality of narrow lengths of parts of hook and loop material outlining rows and columns of numbers whereby each number is encompassed by a square of the hook and loop material;

c) storing on said playing surfaces a plurality of playing chips, each of said playing chips having a flocking material which allows said playing chips to be removably retained on said playing surfaces; and d) moving a playing chip from a playing surface to an encompassed number on a bingo playing card when said encompassed number is called whereby said lengths of parts of hook and loop material retains said playing chip where placed.

* * * * *